US008601966B2

(12) United States Patent
Bermudez Miquel et al.

(10) Patent No.: US 8,601,966 B2
(45) Date of Patent: Dec. 10, 2013

(54) SET OF STOWABLE RIGID SAILS

(76) Inventors: Jose Bermudez Miquel, Piera (ES); Ignacio Bermudez Sanchez, Piera (ES)

( * ) Notice: Subject to any disclaimer, the term of this patent is extended or adjusted under 35 U.S.C. 154(b) by 0 days.

(21) Appl. No.: 13/256,944

(22) PCT Filed: Mar. 15, 2010

(86) PCT No.: PCT/ES2010/000121

§ 371 (c)(1),
(2), (4) Date: Nov. 21, 2011

(87) PCT Pub. No.: WO2010/106207

PCT Pub. Date: Sep. 23, 2010

(65) Prior Publication Data

US 2012/0132117 A1 May 31, 2012

(30) Foreign Application Priority Data

Mar. 16, 2009 (ES) ..... 200900791

(51) Int. Cl.
*B63H 9/04* (2006.01)

(52) U.S. Cl.
USPC ..... 114/102.22; 114/102.24; 114/102.26; 114/102.29; 114/39.31; 114/102.33

(58) Field of Classification Search
USPC ..... 114/102.15, 102.22, 102.24, 102.26, 114/102.29, 102.33
See application file for complete search history.

(56) References Cited

U.S. PATENT DOCUMENTS

| | | | | | |
|---|---|---|---|---|---|
| 2,484,687 | A * | 10/1949 | Carl, Jr. | 114/102.22 |
| 3,934,533 | A * | 1/1976 | Wainwright | 114/39.31 |
| 4,335,671 | A * | 6/1982 | Warner et al. | 114/274 |
| 4,388,888 | A * | 6/1983 | Gushurst, Jr. | 114/90 |
| 4,402,277 | A * | 9/1983 | Wainwright | 114/102.22 |
| 4,418,632 | A * | 12/1983 | Yoshimi et al. | 114/102.32 |
| 4,537,146 | A * | 8/1985 | Wainwright | 114/102.16 |
| 4,685,410 | A * | 8/1987 | Fuller | 114/39.31 |
| 4,895,091 | A * | 1/1990 | Elmali et al. | 114/102.24 |
| 4,993,348 | A * | 2/1991 | Wald | 114/265 |
| 5,027,735 | A * | 7/1991 | Labrador | 114/39.26 |
| 5,271,349 | A * | 12/1993 | Magrini | 114/102.33 |
| 5,937,778 | A * | 8/1999 | McCabe | 114/102.13 |
| 6,105,524 | A * | 8/2000 | Dane | 114/39.21 |
| 7,146,918 | B2 * | 12/2006 | Meller | 114/39.26 |
| 7,298,056 | B2 * | 11/2007 | Gizara | 290/54 |
| 8,281,727 | B2 * | 10/2012 | Gonen | 114/102.29 |
| 2004/0080166 | A1 * | 4/2004 | Davidson | 290/55 |
| 2005/0252764 | A1 | 11/2005 | Meller | |
| 2011/0139052 | A1 * | 6/2011 | Burandt | 114/39.29 |
| 2012/0061522 | A1 * | 3/2012 | Sullivan et al. | 244/198 |

FOREIGN PATENT DOCUMENTS

| | | |
|---|---|---|
| DE | 3100102 | 8/1982 |
| DE | 4436334 | 1/1996 |
| ES | 2311399 | 2/2009 |
| FR | 2648426 | 12/1990 |
| JP | 56116593 | 9/1981 |
| WO | WO01/28851 | 4/2001 |
| WO | WO01/89923 | 11/2001 |
| WO | WO2004/024556 | 3/2004 |

OTHER PUBLICATIONS

International Search Report for PCT/ES2010/000121, mailed completed May 27, 2010.

* cited by examiner

*Primary Examiner* — Lars A Olson
*Assistant Examiner* — Jovon Hayes
(74) *Attorney, Agent, or Firm* — Barnes & Thornburg LLP

(57) ABSTRACT

A set of rigid sails that have an aerodynamic profile and that may be secured to a boat.

17 Claims, 23 Drawing Sheets

Fig. 2
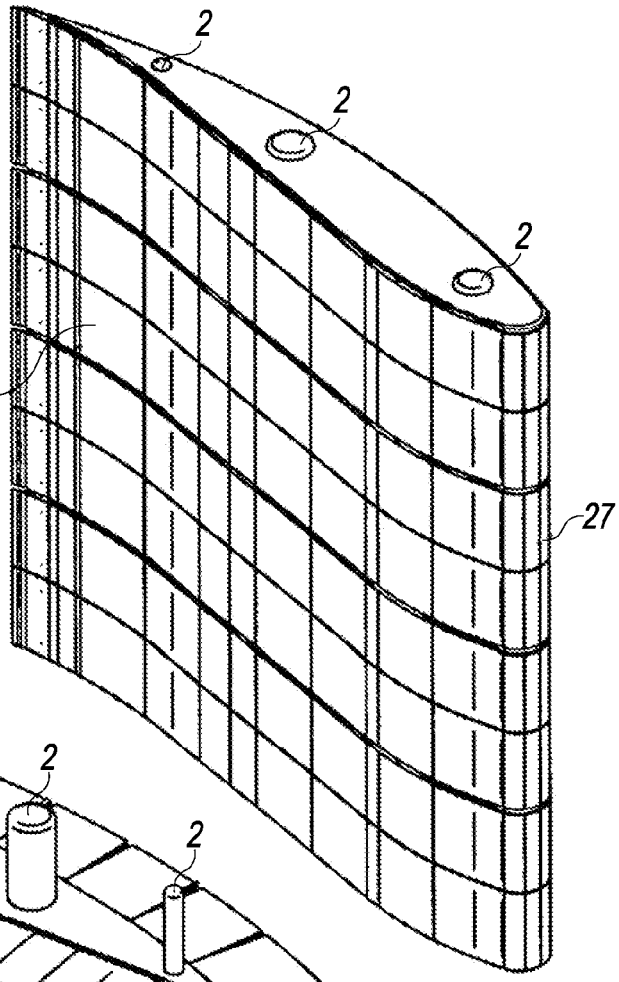
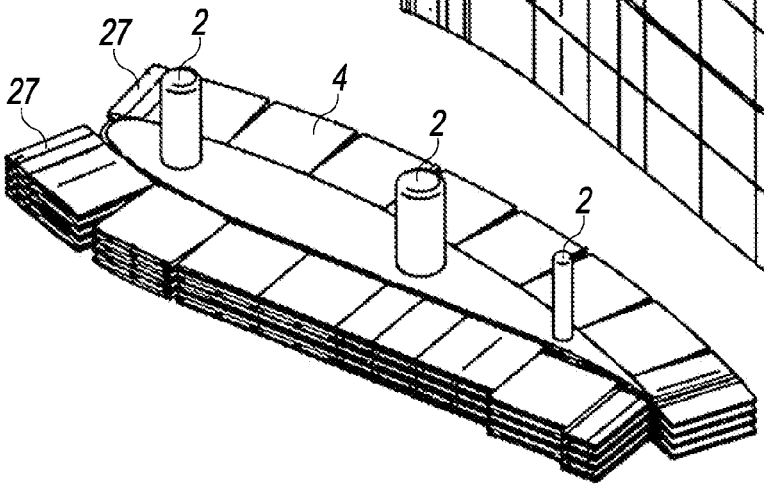
Fig. 3

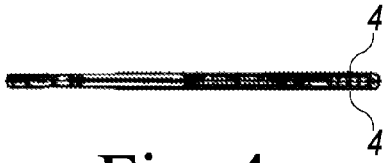
Fig. 4
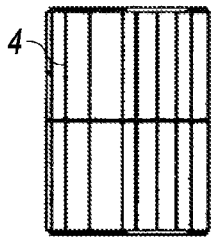
Fig. 5
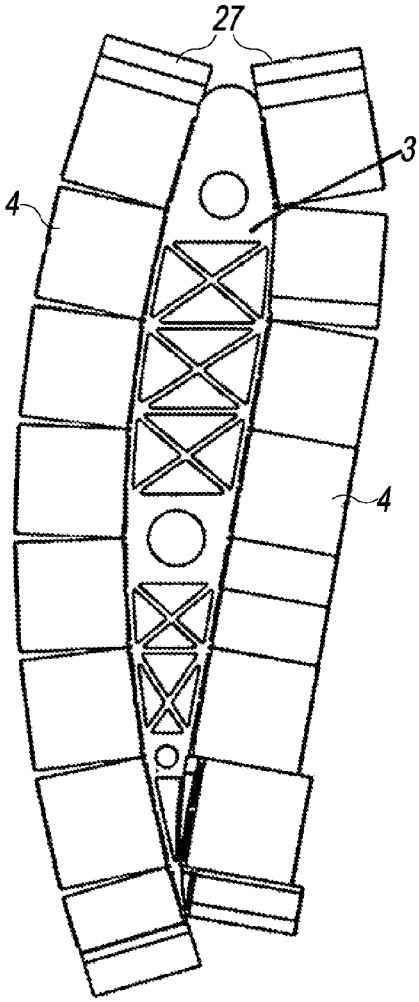
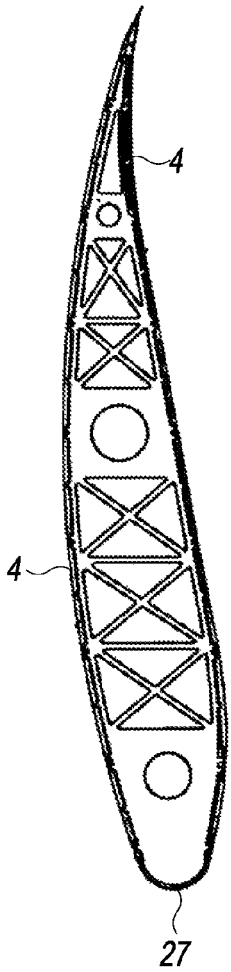

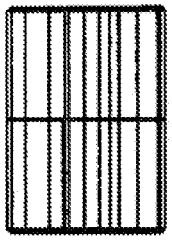
Fig. 6
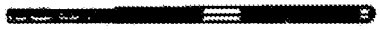
Fig. 7
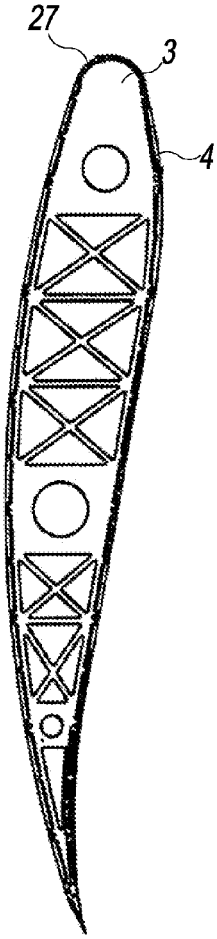
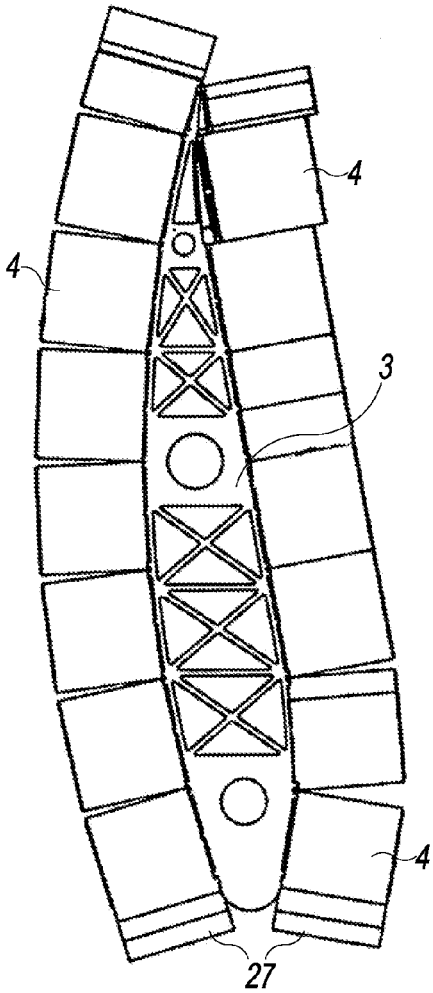

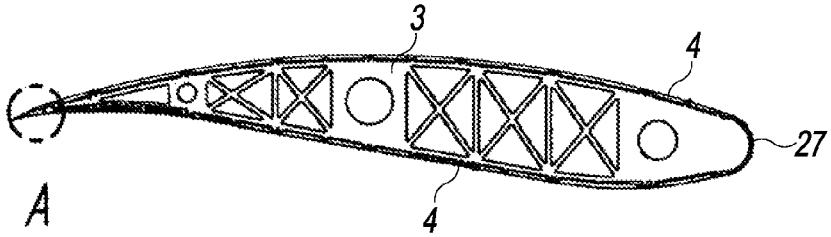
Fig. 13
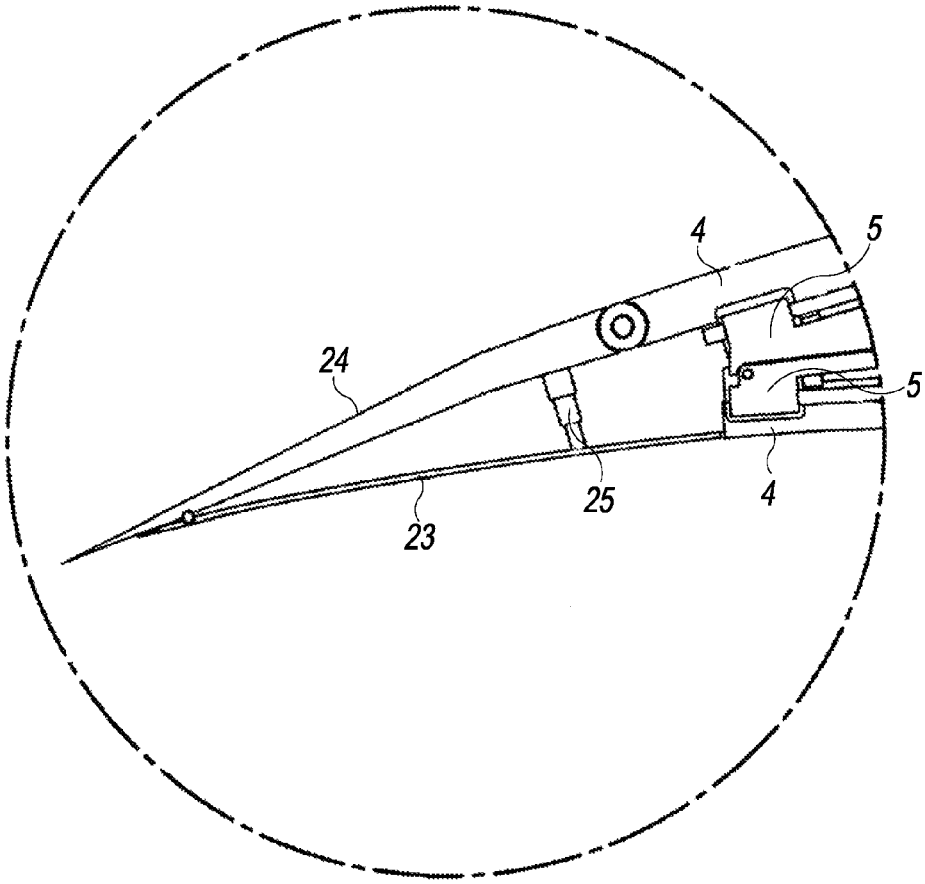
DETAIL A

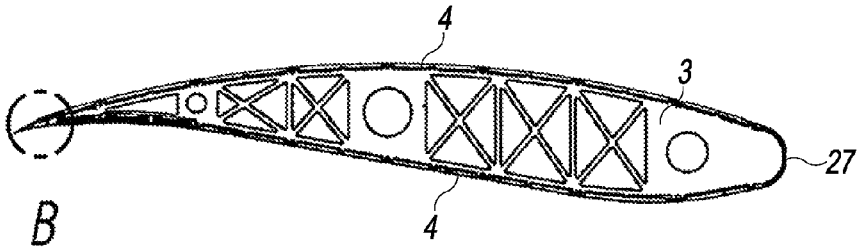
Fig. 14
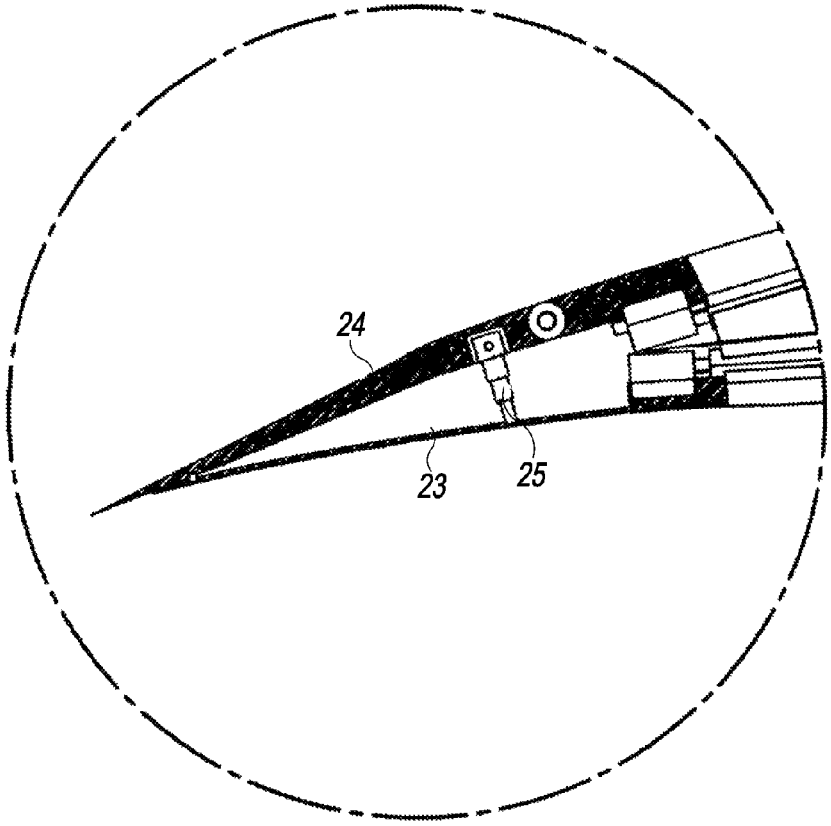
DETAIL B

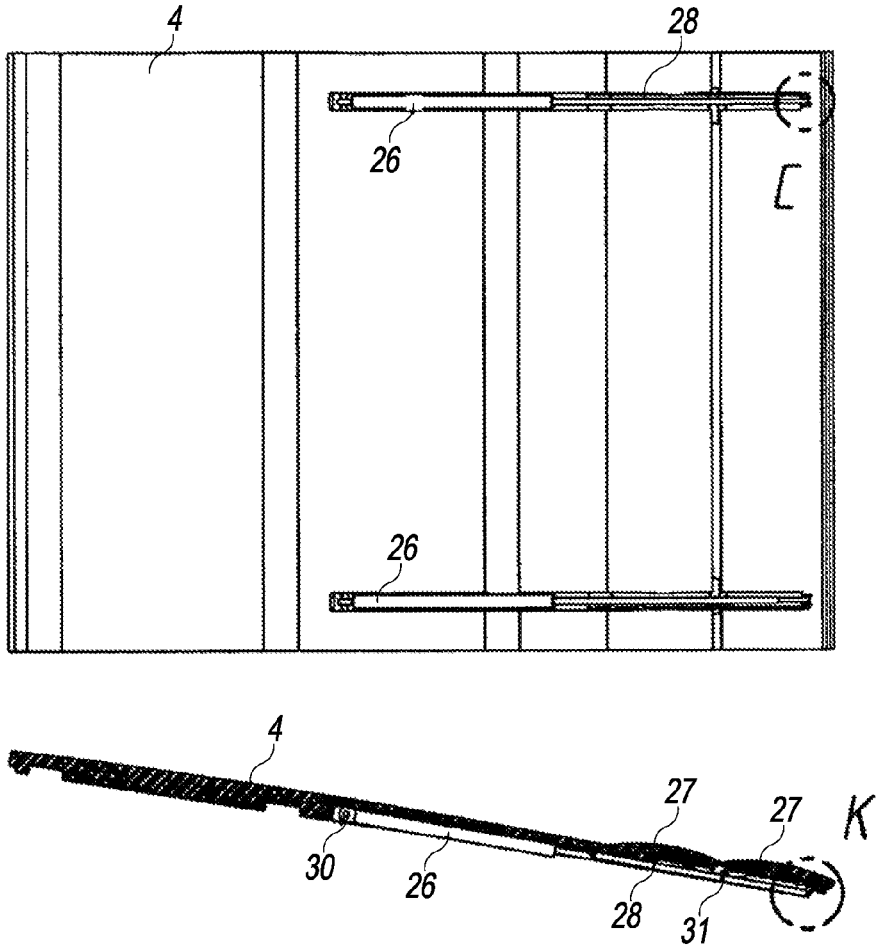
Fig. 15
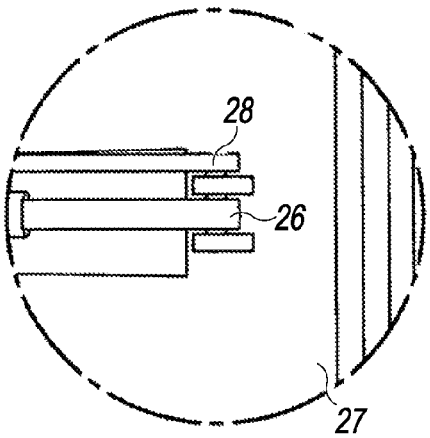
DETAIL C
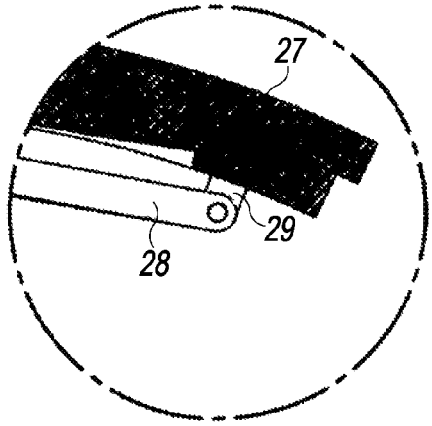
DETAIL K

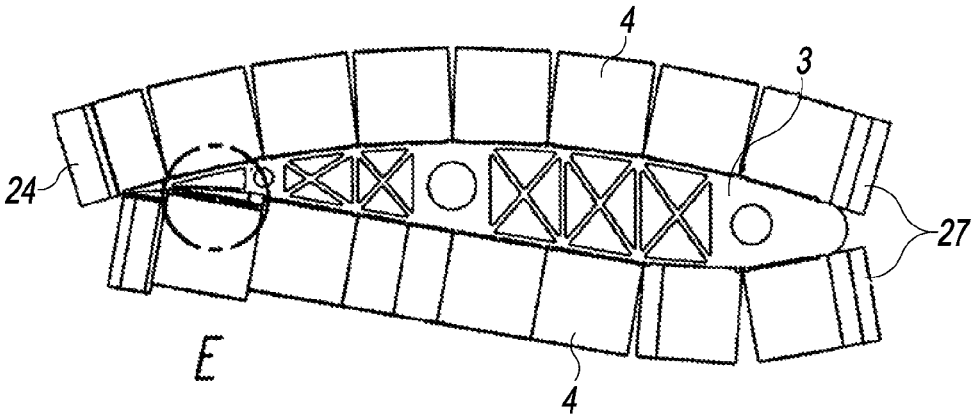
Fig. 16
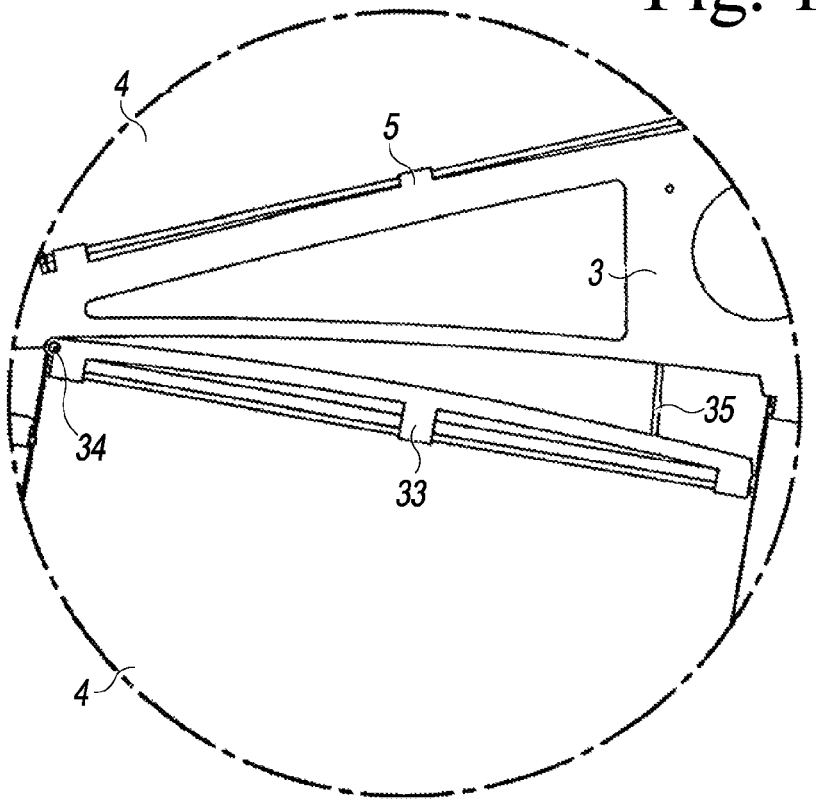
DETAIL E

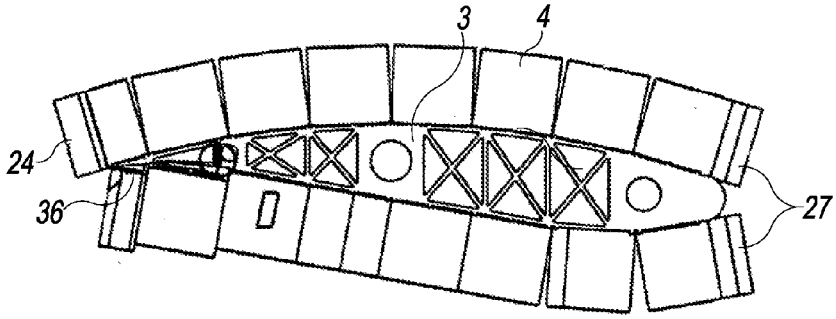
Fig. 17
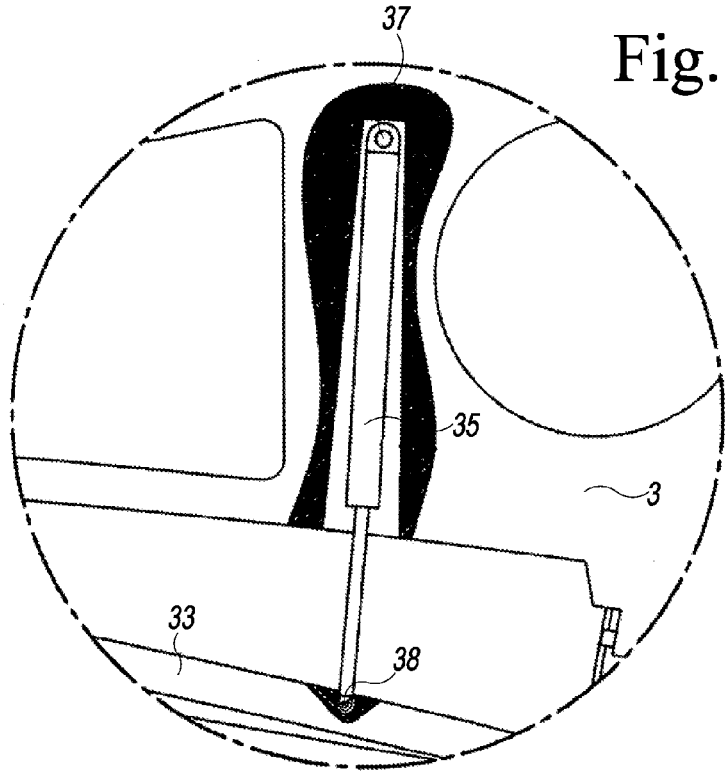
DETAIL D

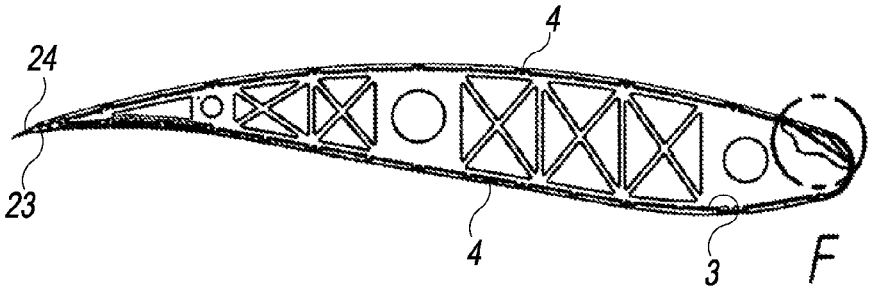
Fig. 18
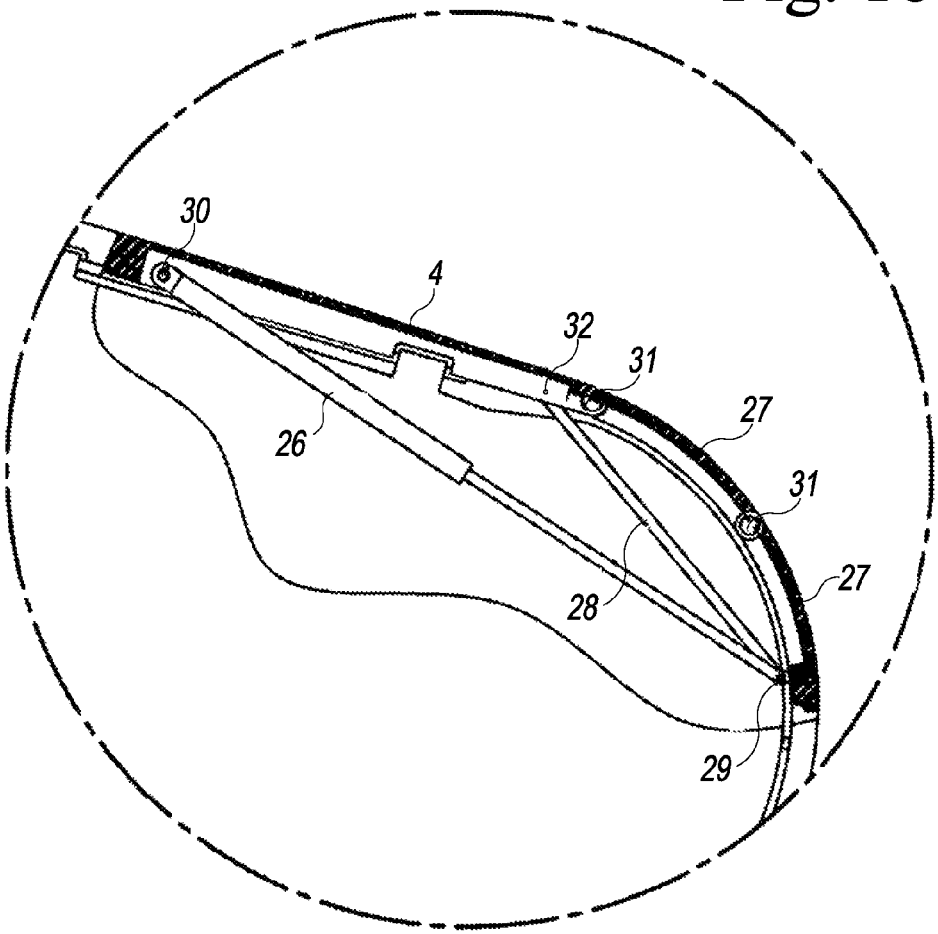
DETAIL F

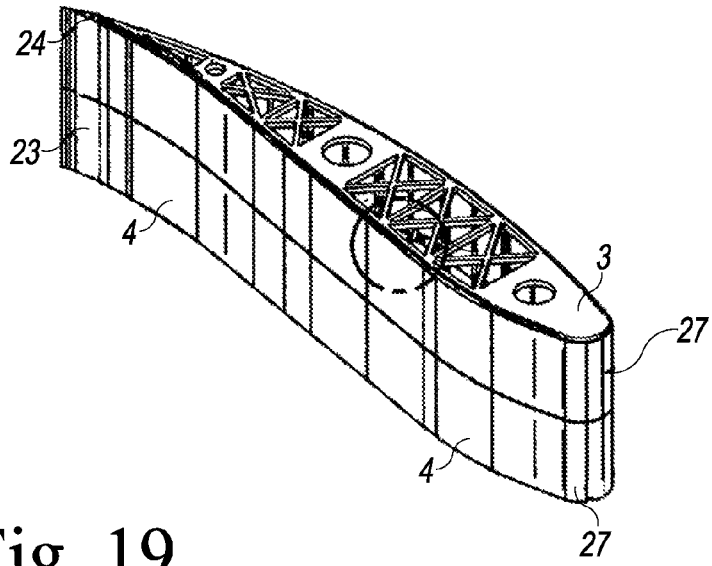
Fig. 19
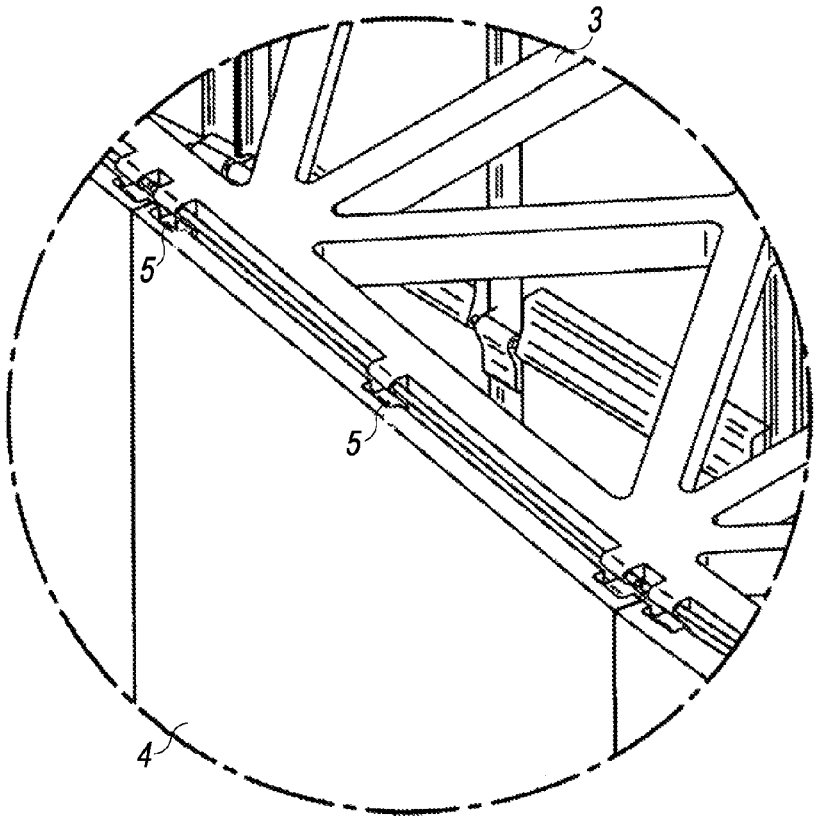
DETAIL I

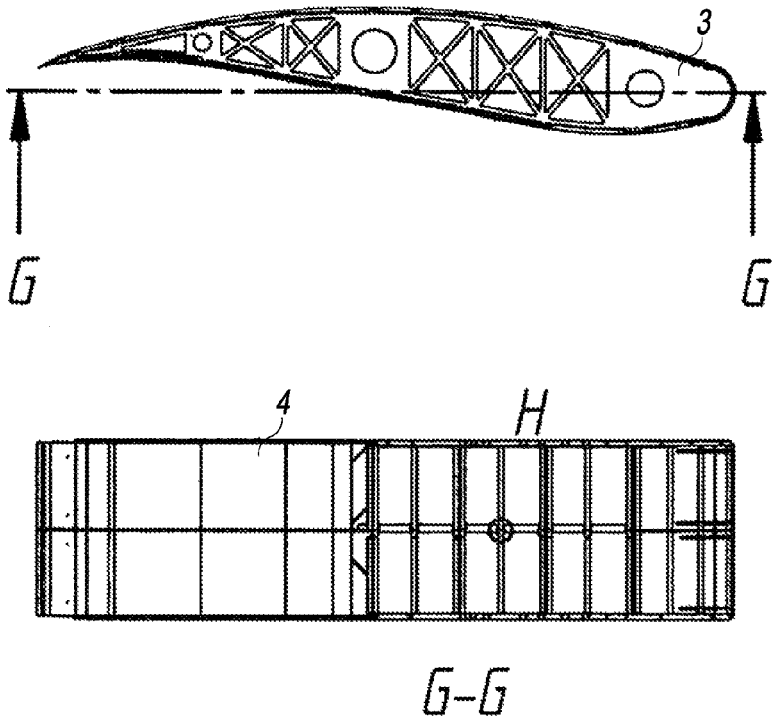
Fig. 20
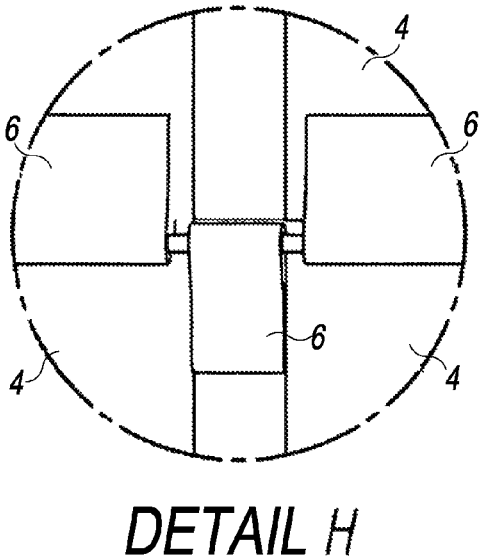

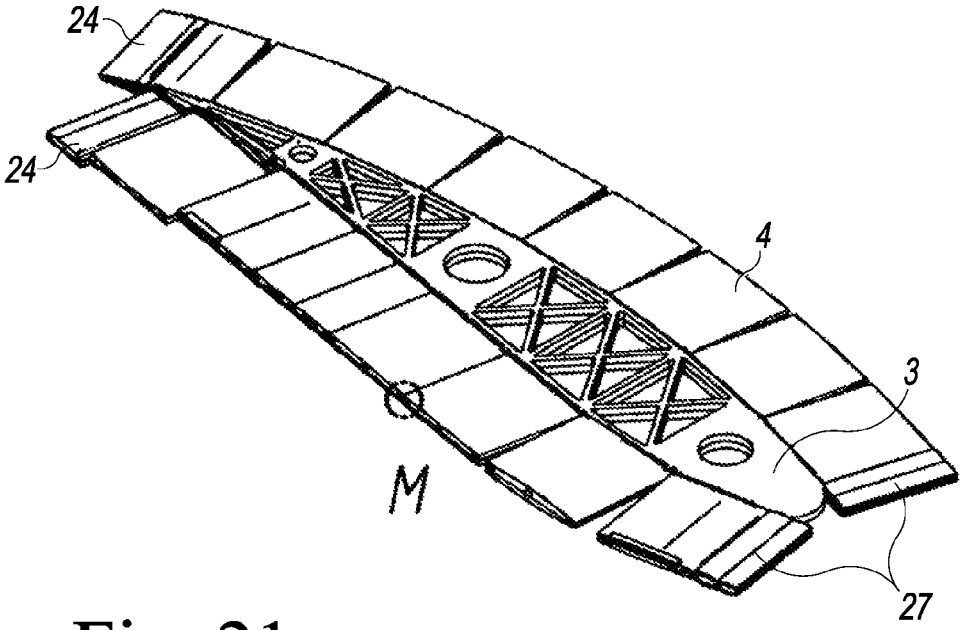
Fig. 21
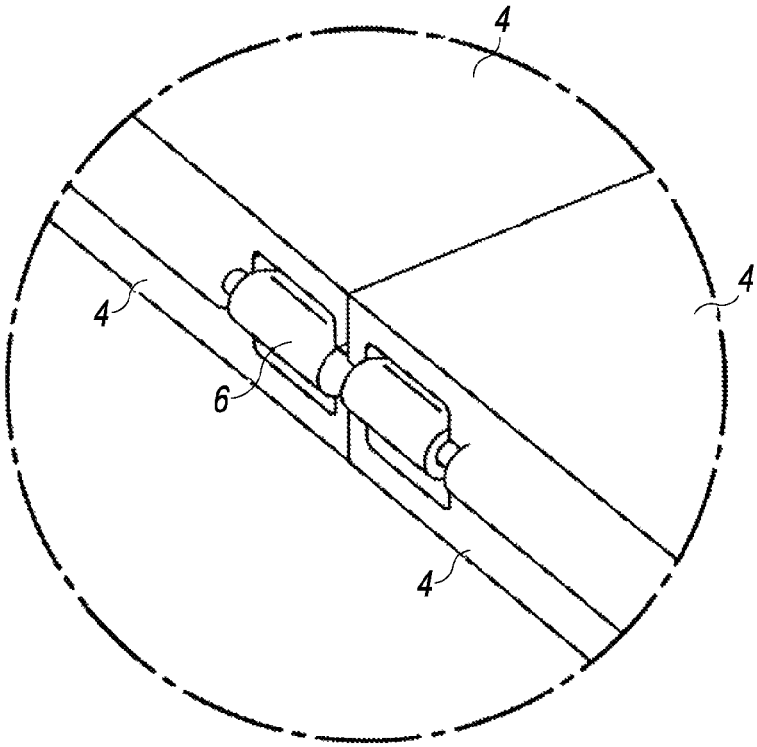
DETAIL M

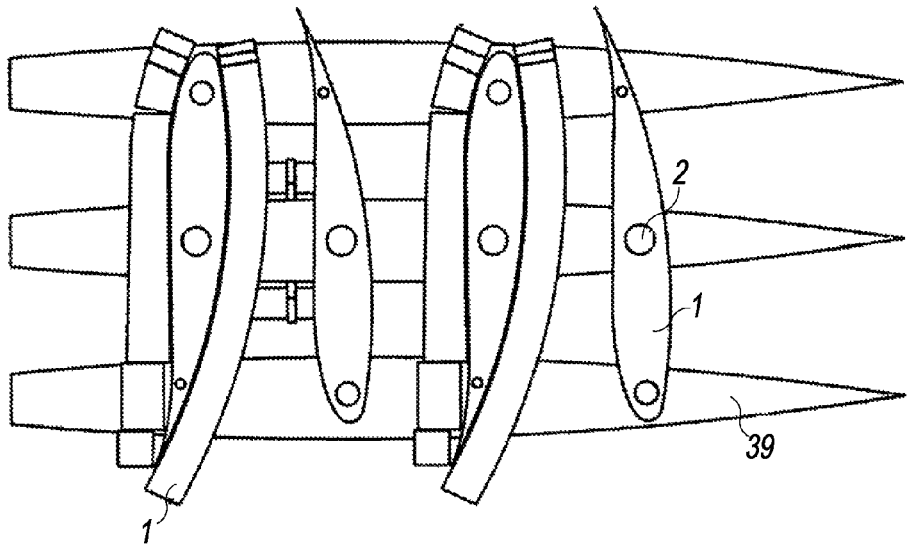
Fig. 25
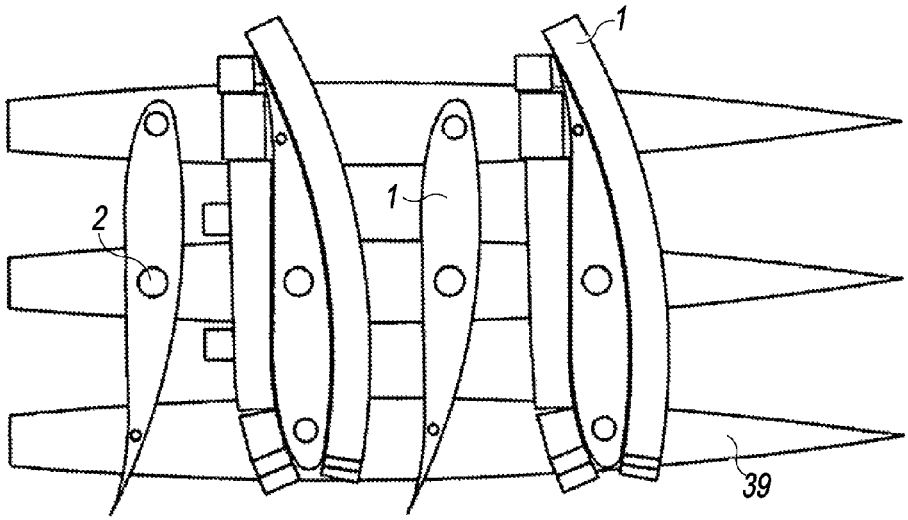

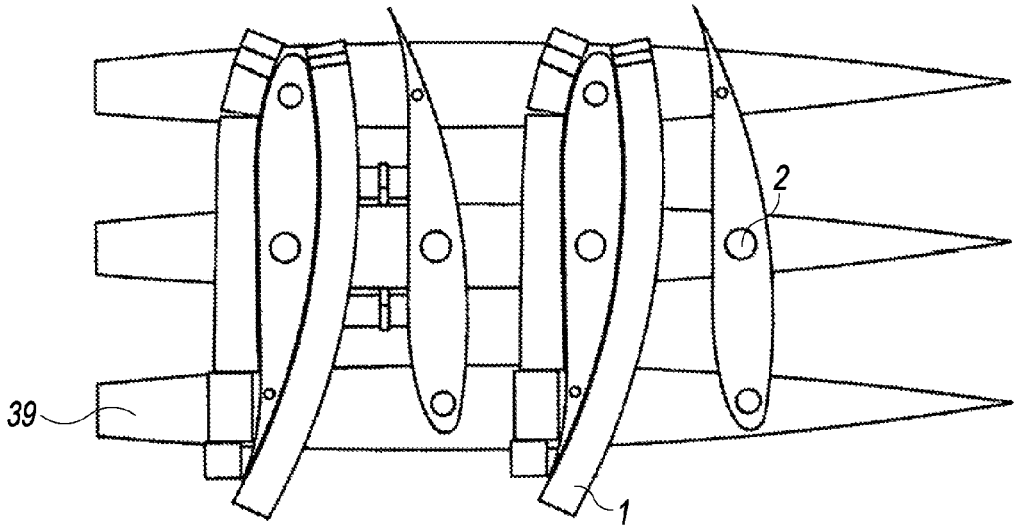
Fig. 26
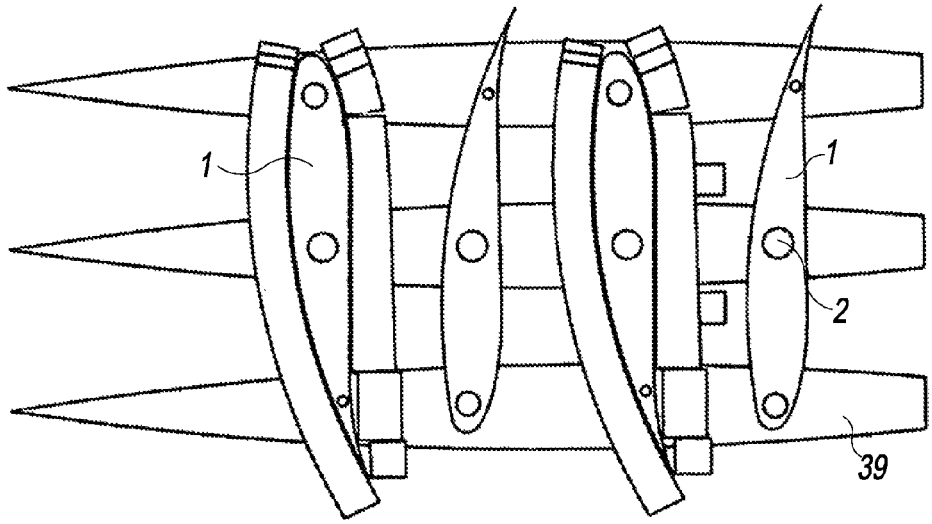

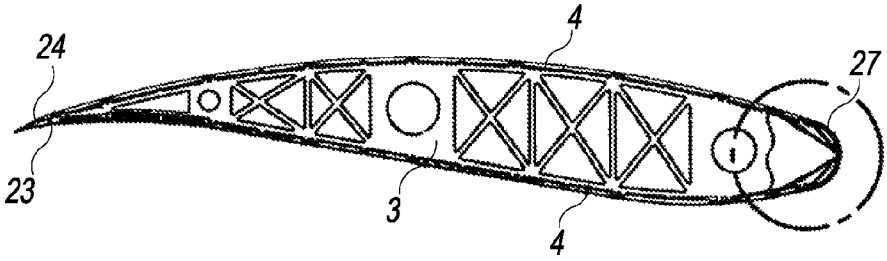
Fig. 27
L
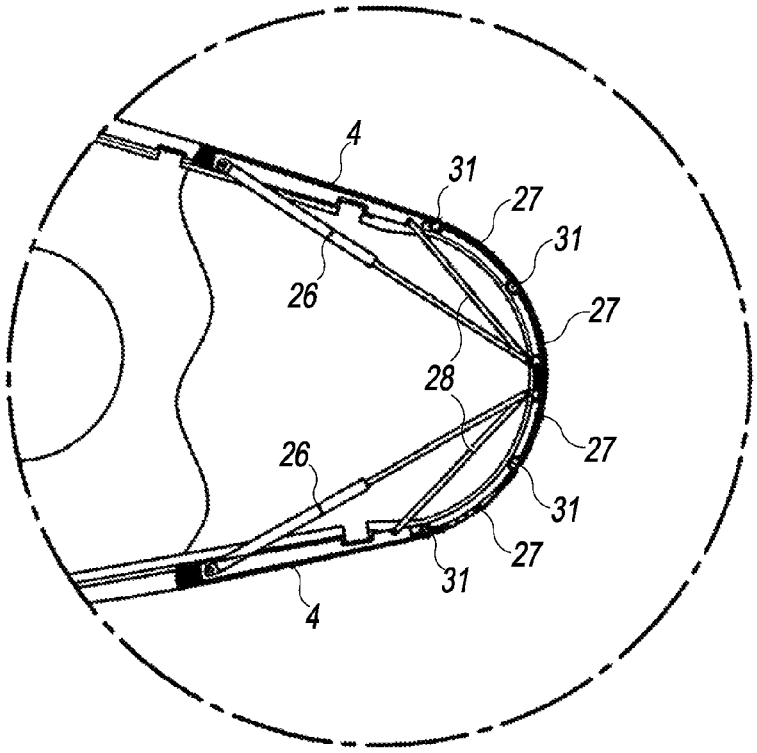
DETAIL L

SET OF STOWABLE RIGID SAILS

CROSS-REFERENCE TO RELATED APPLICATIONS

This application is a U.S. national counterpart application of PCT International Application Serial No. PCT/ES2010/000121, filed Mar. 15, 2010, which claims priority to Spanish Patent Application Serial Number P200900791 filed Mar. 16, 2009. The disclosures of both of which are hereby incorporated herein by reference.

FIELD OF THE INVENTION

The present invention refers to a set of stowable rigid sails with a aerodynamic profile shape, that find application for driving ships and for generating power from wind.

BACKGROUND OF THE INVENTION

In the fluid mechanics it is known that the efficiency of the cloth sails is lower than the wings of the aeroplanes. In these wings, the difference between the lift strength and the weight permits the aeroplane to flight, because the aerodynamic limit layer of the air does not come off the profile. On the contrary, in the conventional sails in the naval sector, it the wind push which inflates the sail and produces, by thrust, a resulting strength that permits the advancement of the ship or vessel.

During long time a sail for aquatic navigation presenting the advantages of the aviation wings has been desired. To this end, there have been some attempts to provide rigid sails with an aerodynamic profile of aeronautic kind Among them it must be cited the Flettner rotors already disclosed in 1926 by Anton Flettner (FLETTNER, Anton, "Mein Weg zum Rotor", Leipzig (Köhler & Amelang, 1926)), cited e.g. in EP 040 597.

WO 2004024556 discloses a rigid sail comprising two parts that can be relatively rotated about a vertical axis to determine the intrados and extrados of a sail like an aerodynamic profile of those used for the wings of the aeronautic technics.

WO 0189923 discloses a rigid sail with a hinged aerodynamic profile that comprises three vertical elements (or modules), each of them being formed by three horizontal elements (or sections) hinged to each other or extrados from the rigid wing or sail.

U.S. Pat. No. 7,146,918 discloses a system for generating electric power and hydrogen from sea water and wind power, in systems floating in water comprising rigid sails.

FR 2648426 discloses a wing comprising a rigid part and a flexible part that houses inside a housing in the rigid part, permitting different aerodynamic configurations.

ES 2311399 discloses a rigid sail with a configurable profile, with closing elastic sheets, joined to the corresponding wall in at least a zone close to said end edge and means for generating and feeding pressurized air and vacuum to inflate and deflate the sails to voluntarily change the profile of the sail.

However, these attempts, from which only some illustrative examples have been cited, have not achieved yet a versatile, cheap and easy operated device. The object of the present invention is to provide a solution to this need.

SUMMARY OF THE INVENTION

To this end, the object of the invention is a set of stowable rigid sails, that is characterised in that, according to the characterising portion of claim 1, it comprises pairs of opposed sails, each comprising extensible masts, sections that longitudinally slide along said masts and panels, hinged to the sections and to each other, that conform the side surface of each sail, said panels being operative between two positions: an unfolded operative position, in which they are essentially coplanar and longitudinally aligned in a essentially vertical direction; and a folded rest position, in which they are bellows-like pilled, with the essentially horizontal sections (3).

In claims 2 and the following ones preferred embodiments of the present invention are disclosed.

It must be cited again that the rigid sails will be preferably associated with a ship hull; furthermore, the object of the invention considers during their use that one of the sails will be in an extended vertical position and other one in the folded position, for their optimal performance, and in cases with strong winds both could be folded.

The rigid sails of the invention are applicable to the movement of a ship, and they can be also applied for generating a brake effect to transform the wind power in rotation power in a turbine axis, because they are associated to turbine means.

The rigid sail according to the invention can be associated to means for generating electric power and pressurized air by respectively alternators associated to the turbines or compressors associated to them.

BRIEF DESCRIPTION OF THE DRAWINGS

In the attached drawings as a non-limitative example is shown an embodiment of the rigid sails object of the invention. In said drawings:

FIG. 2 is a perspective view of an unfolded rigid sail;

FIG. 3 is a perspective view of an opposed and folded rigid sail;

FIG. 4 is a plan and elevated view of a folded sail module;

FIG. 5 is a plan and elevated view of an unfolded sail module;

FIG. 6 is a plan and elevated view of the same module of FIG. 4 unfolded;

FIG. 7 is a plan and elevated view of the same module of FIG. 5 folded;

FIG. 13 is a plan view, with the detail of the output edge in the unfolded working position;

FIG. 14 is the same view than FIG. 14 sectioned;

FIG. 15 is a plan and elevation view showing the attack edge prepared for its folding;

FIG. 16 is a plan view showing the fold where the profile forms internal curves;

FIG. 17 is the same view than FIG. 16 sectioned;

FIG. 18 is a plan view showing the attack edge in a working position with the sails unfolded;

FIG. 19 is a perspective view showing the rotatable hinges between the section and panel;

FIG. 20 is a plan and elevation view showing the rotatable hinge between panel and panel;

FIG. 21 is a perspective view of the rotatable hinge between panel and panel;

FIG. 25 is a plan view where some of the sails are shown folded and their opposed unfolded.

FIG. 26 is the same view than FIG. 24, but in a plan view.

FIG. 27 is a plan view of the attack edge.

DETAILED DESCRIPTION OF THE DRAWINGS

Figure 1:
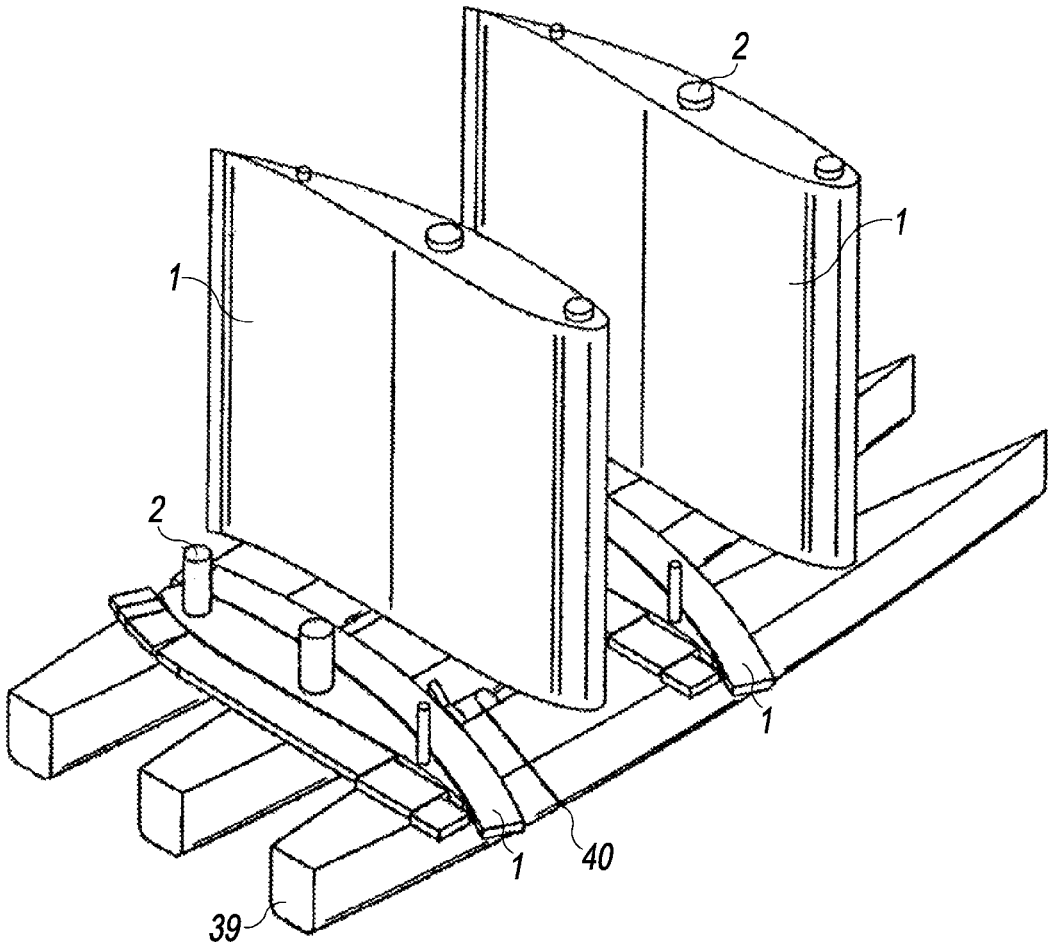
FIG. 1 is a perspective view of a ship including rigid sails according to the invention.
Figure 8:
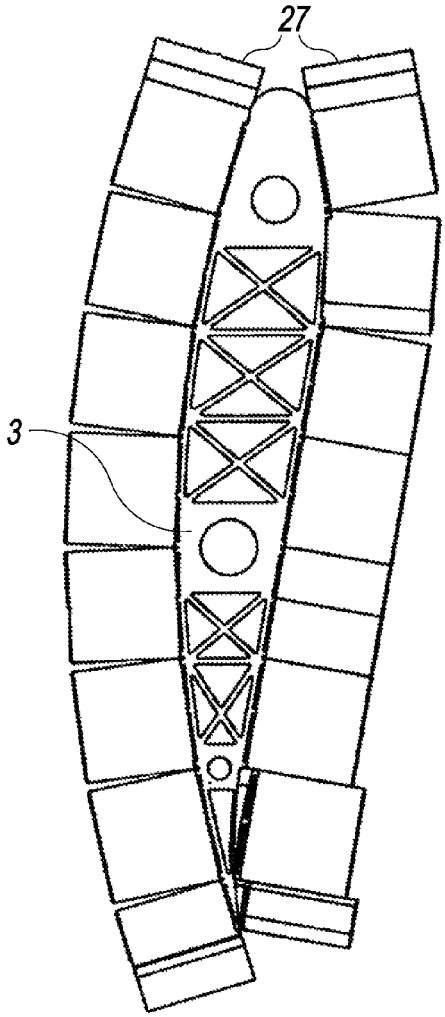
FIG. 8 and FIG. 9 are a plan and elevated view of the previously cited modules, both folded.
Figure 9:
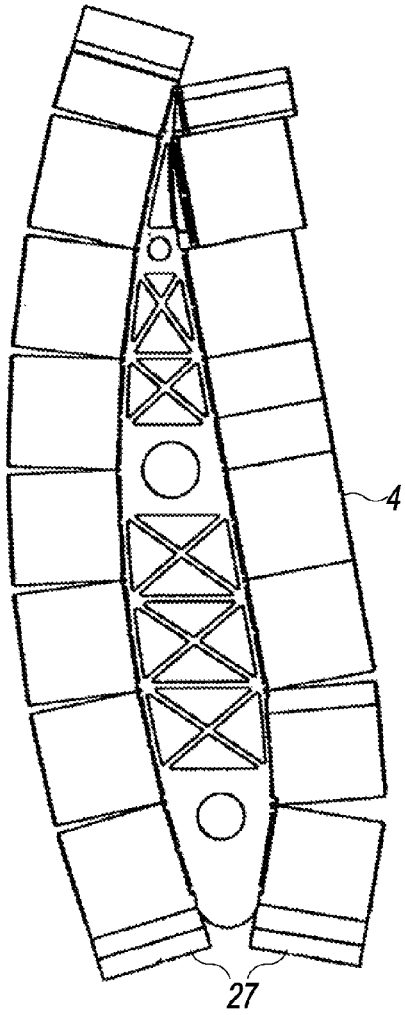

In said drawings a ship 39 can be seen including, in this exemplary embodiment, four set of sails according to the invention. It is clear that the concept is extensible to any kind of boat with a different number of sails 1.

The rigid sails 1 of the invention have an aerodynamic profile, and they have a particular, but not exclusive, application in boats for generating mechanical and electric power, and for obtaining pressurized air as a energetic vector. To this end, the boat 39 includes a turbine 40 for generating a brake effect, thanks to the high power excess recovered by the sail profile 1 (as will be explained hereinafter), to transform the wind power in rotation mechanical energy at an axis of the turbine, that by an alternator can be converted in electric power.

To this end, the rigid sails 1, according to the invention, and as can be seen in detail in FIGS. 1-27, are formed by telescopically extensible masts 2, which are driven by hydraulic cylinders 22 with its corresponding central (a system identical to the standard extensible cranes), sections 3 that vertically move on said masts 2 and panels 4 conforming the side surface of each sail. The sections 3 carry hydraulic and/or pneumatic cylinders or fixation electromechanical actuators 15 to the masts 2.

The panels 4 are joined to the sections 3 by rotatable hinges 5, permitting the free rotation, and they are joined to each other by hinges 6, permitting also the free rotation, according to FIGS. 10, 19, 20 and 21.

The sections 3 are each joined with the following one by struts 7; an end of each strut 7 is fixed by the internal part to each of the sections 3, and the other end is moved by the holes 8 placed inside the sections 3 until it abuts against the housing 9 placed at the upper part of the sections 3.

At the ends of each upper length of each of the masts 2 a base 11 is fixed, with the pulleys 12 and a carcass 13.

Through the pulleys 12 a cable 18 slides, from which an end is fixed to the upper section 3 by the anchorage 19 and the other is fixed to the base 14 by the anchorage 20, and said base is integral with the second length of the telescopic mast 2.

Figure 10:
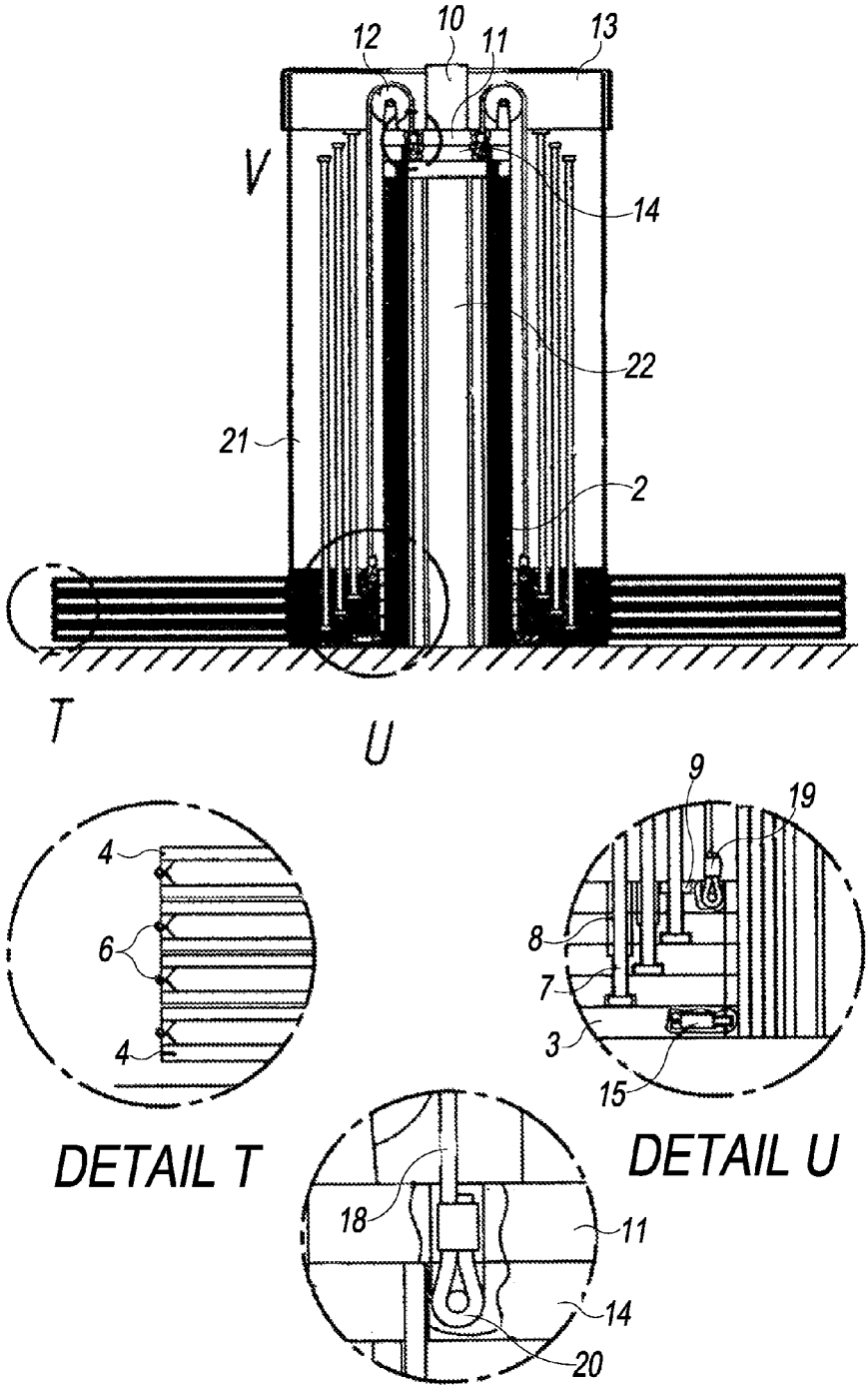
FIG. 10 is an elevation view of a set of four folded modules.
Figure 11:
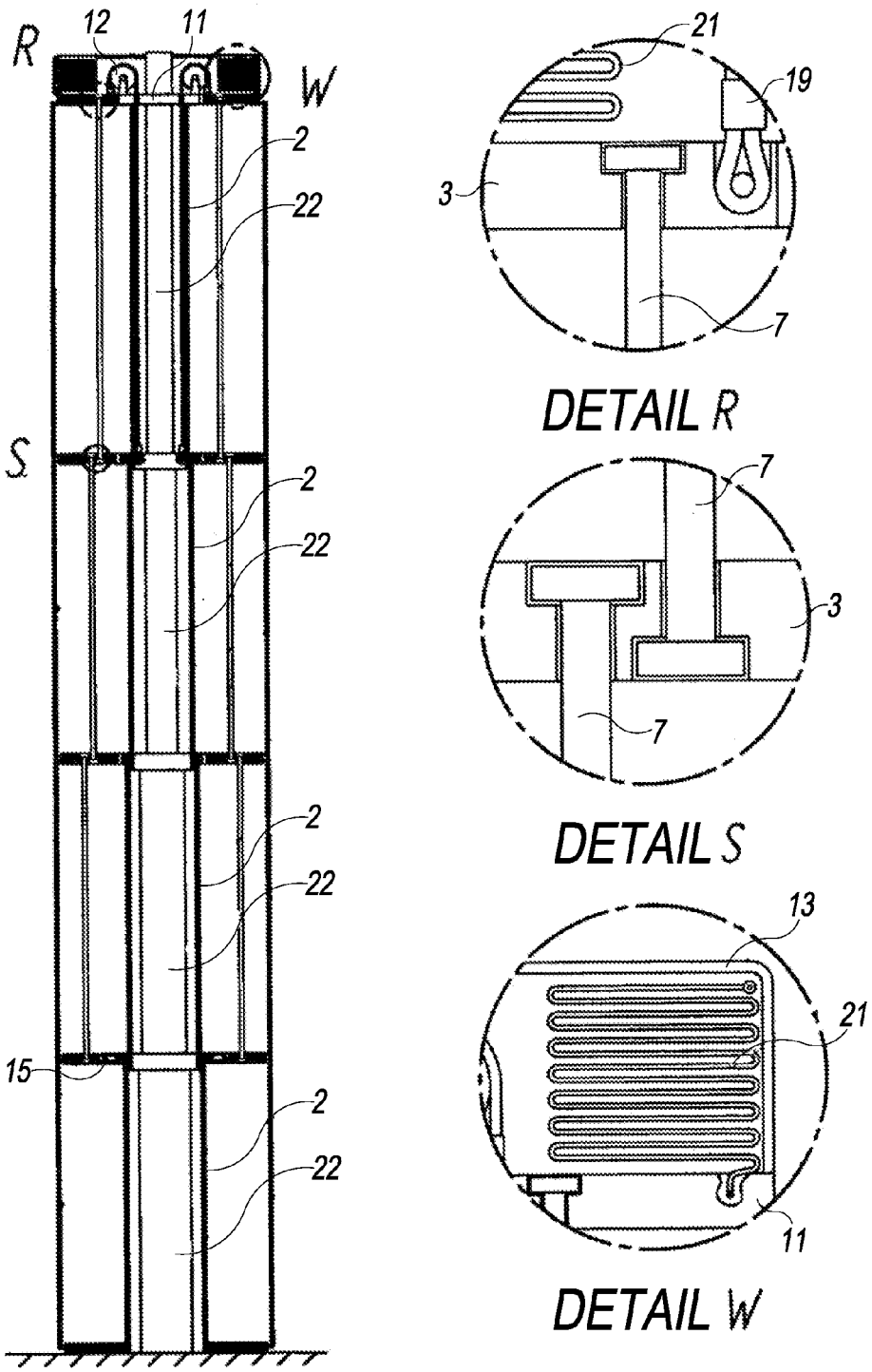
FIG. 11 is an elevation view of four unfolded modules.
Figure 12:
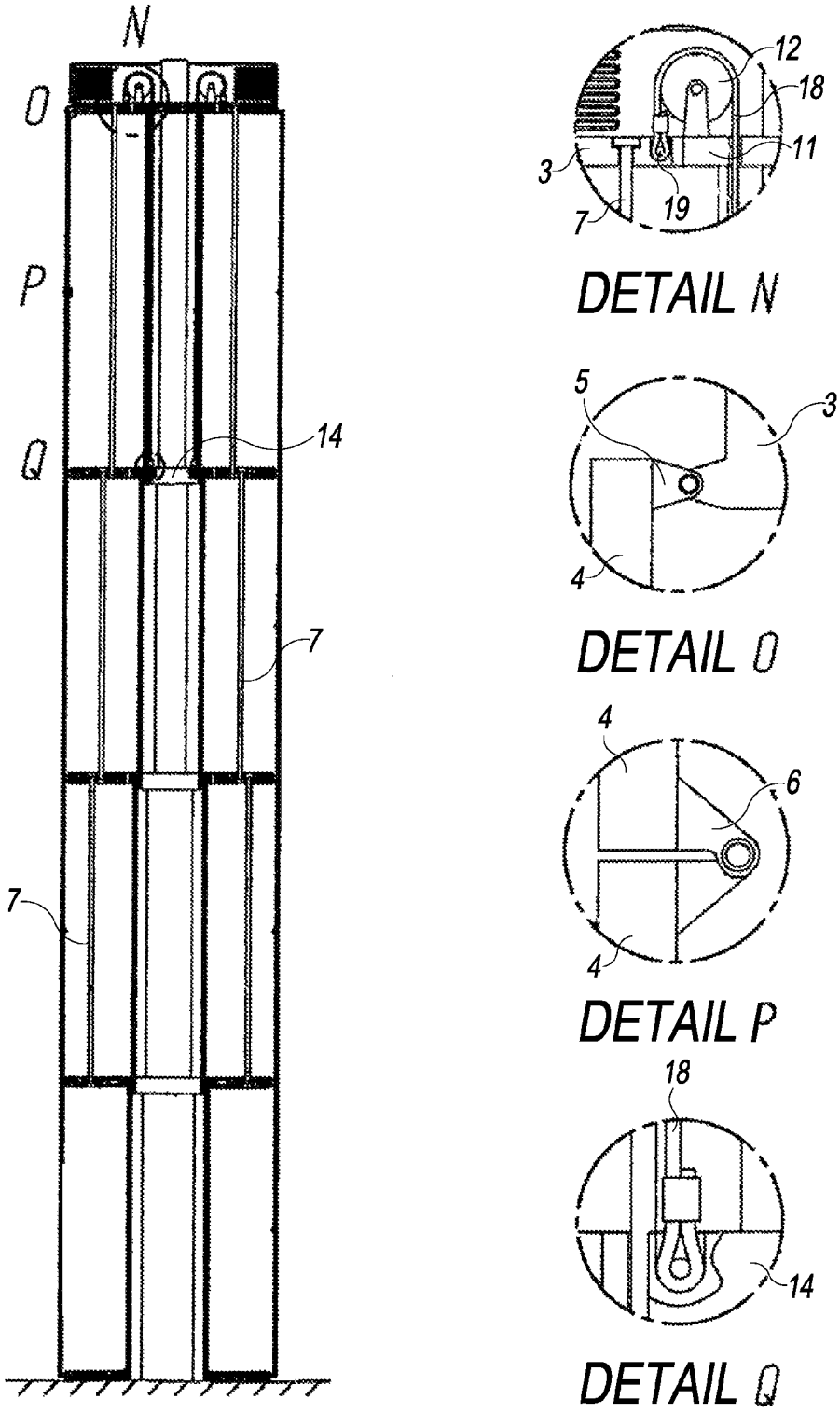
FIG. 12 is the same view than FIG. 12 with more details.
Figure 22:
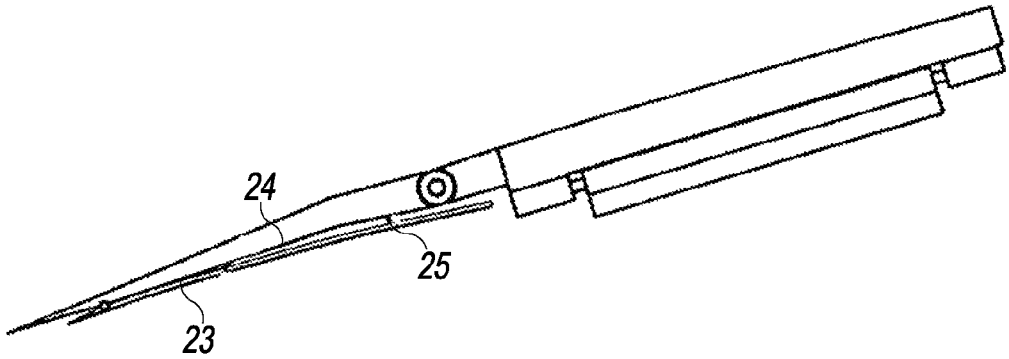
FIG. 22 is a plan view showing the panel of the output edge prepared to be folded.
Figure 23:
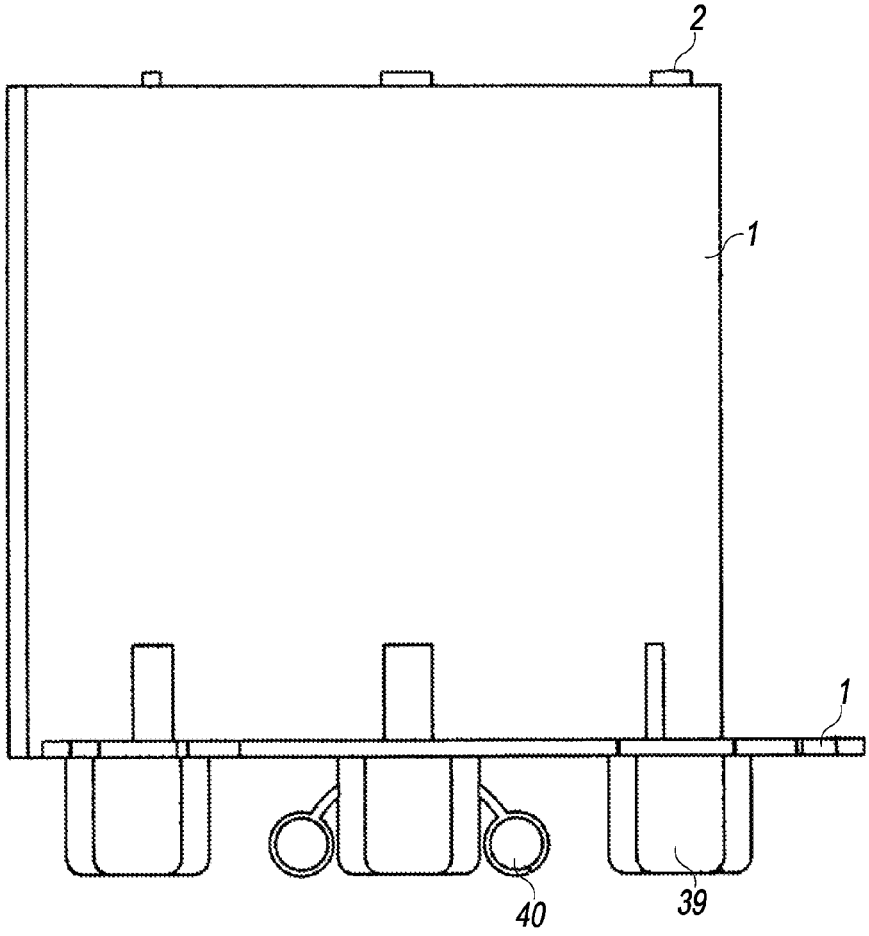
FIG. 23 is a rear view of a ship with a pair of unfolded sails and another pair folded.

At the carcass 13 is fixed an elastic envelope 21, fixed at one end to the carcass 13 and at the other end to the upper section 3, which when the sails are folded, according to FIG. 10, it remains extended covering the whole set; when the sails are unfolded, said envelope 21 remains inside the carcass 13, according to FIG. 11.

For the unfolded position of the sails 1, the last length of the panel of the output edge 24, according to FIG. 13, must include hydraulic, mechanical or electromechanical driving means 25, which permit to move the panel defining the output edge 23. In said FIG. 13 the system in the working position of the sails 1 is shown, and in FIG. 22 it is shown to be folded. Furthermore, the panels 24 extend along the output edge of all the panels 4.

Regarding the attack edge, along the whole vertical length of the panels 4, they are joined by the hinges 31 to the curved panels 27. In the working position (unfolded) of sails 1, so that the panels 27 are adapted to the shape of the sections 3, cylinders 26 are used, which define by the struts 28 the perfect adaptation to the previously cited shape, according to FIG. 18; it must be pointed out that said cylinder 26 freely rotates by hinges 29 and 30, and the strut 28 freely rotates between hinges 32 and 29. For the folded position, according to FIG. 15, the cylinder 26 retracts its rod and obtains an alignment between the panels 4 and 27 by the strut 28.

For the folding, it is necessary to move all the needed panels of the intrados part, because in their original position they do not permit said folding because there is a superposition to each other, because they are at the inner curve zone; in the example shown, said panels 4 are joined to the pieces 33 and 36, which are fixed to the sections 3 by the hinges 34. For the movements, cylinders or actuators 35 are used, which are fixed at an end to the sections 3 by hinges 37, and at the other end by pieces 33 and/or 36 by hinges 38.

Figure 24:
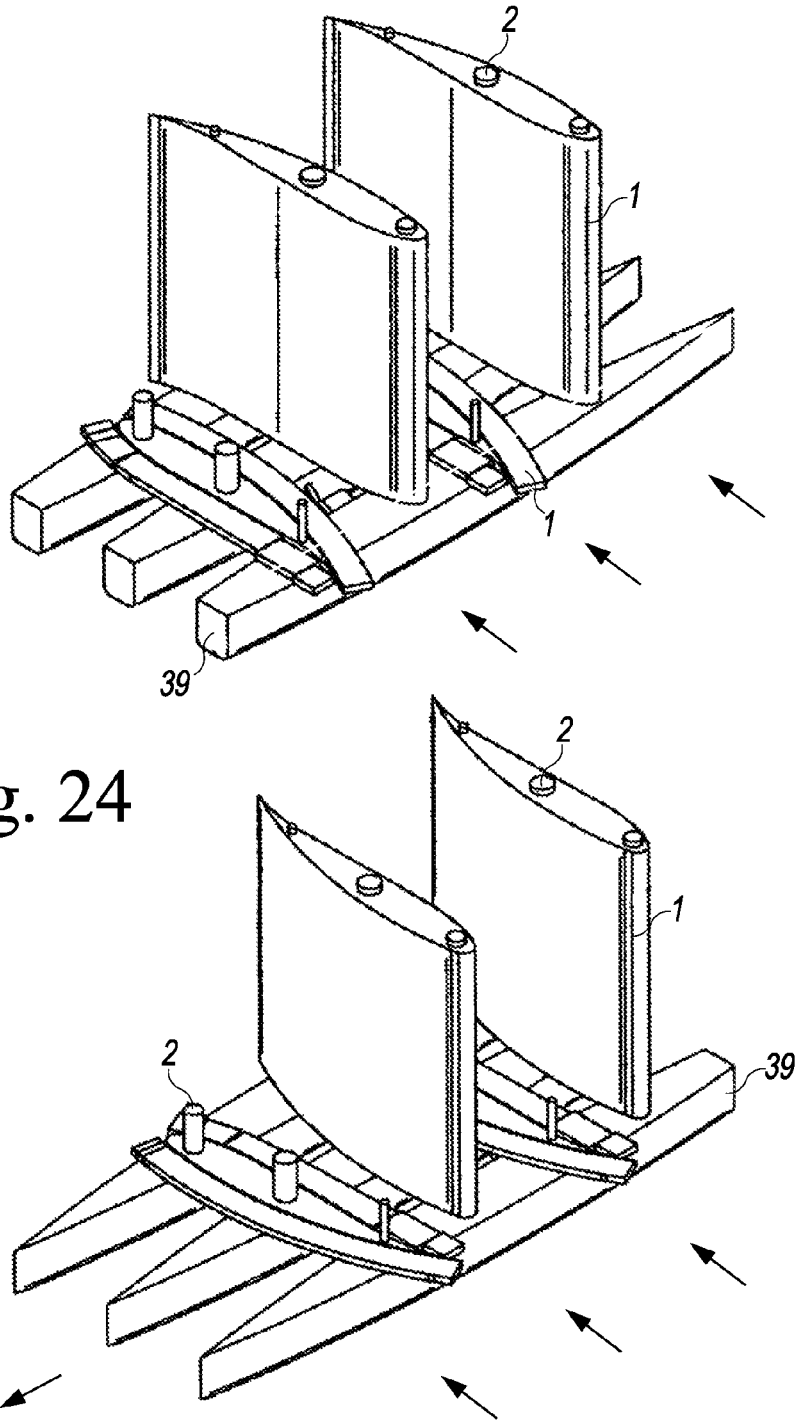
FIG. 24 is a perspective view where the moving direction of the ship is shown, with the wind in the same direction, according to the unfolded sails.

According to FIGS. 24 and 26, it can be seen that when the sails 1 are unfolded (in the working position), the wind direction being the same for both cases, 30 rotating the boat 39 and unfolding the opposed sails 1, the boat changes it direction.

As the nature of the present invention is described enough, and also the way for put it in practice, it is pointed out and anything that do not alter, change or modify its main principle is subjected to detail variations, according to the scope of protection defined in the attached claims.

The invention claimed is:

1. A set of stowable rigid sails with an aerodynamic profile, comprising:

a plurality of sails, each sail comprising:

a number of vertically extendable masts, a number of substantially horizontal frame sections that longitudinally and vertically move on said masts from a stacked position, in which said frame sections keep in contact with each other, to a deployed working position in which said frame sections are placed along the masts, and a plurality of rigid panels to conform the side surface of each sail, said panels being hinged with the frame sections and to each other and said panels being operative between two positions: (i) an unfolded position, in which said frame sections are deployed and said panels are substantially coplanar and substantially longitudinally aligned in a substantially vertical direction to conform the side surface of each sail, and (ii) a folded position, in which the panels are stacked and kept in contact with each other, together with the frame sections.

2. The set of stowable rigid sails of claim 1, further comprising a number of hydraulic cylinders that are operable to extend and to retract the masts.

3. The set of stowable rigid sails of claim 1, further comprising a number of hinged prolongations, and rotatable hinges that join the panels to the sections and to the hinged prolongations.

4. The set of stowable rigid sails of claim 1, further comprising a number of hinges that join the panels to each other.

5. The set of stowable rigid sails of claim 1, further comprising a number of struts that join the frame sections consecutively, a first end of a first strut being fixed to a lower part of a first frame section, and a second end being positioned in a hole defined in the first frame section and abutting a housing of a second frame section.

6. The set of stowable rigid sails of claim 1, further comprising a number of actuators coupled to the sections the actuators being configured to permit the movement of the sections relative to the masts.

7. The set of stowable rigid sails of claim 1, further comprising a base with pulleys and a carcass-fixed to the ends of each upper length of each of the masts.

8. The set of stowable rigid sails of claim 7, further comprising a cable configured to slide relative to the pulleys the cable including a first end fixed to a first frame section and a second end fixed to a cable base, said cable base being integral with an end of the telescopic mast such that at the unfolded position of the masts, the last frame section is positioned at the end of the upper length of the mast and in the folded position, the last frame section is stacked with the other frame sections.

9. The set of stowable rigid sails of claim 7, further comprising an elastic envelope fixed to the carcass at a first end and to the upper section at a second end such that when the sails are folded, the elastic envelope covers the plurality of sails to favour the aerodynamics, and when the sails are unfolded the elastic envelope is positioned within the carcass.

10. The set of stowable rigid sails of claim 1, wherein the panels have hydraulic, mechanical or electromechanical driving means to move the panels to define an output edge.

11. The set of stowable rigid sails of claim 1, further comprising a number of curved panels coupled to the panels along by hinges.

12. The set of stowable rigid sails of claim 1, further comprising a number of cylinders and a number of struts configured to (i) move the panels to adapt to the shape of the frame sections to form an attack edge of the profile in the unfolded position and (ii) obtain an alignment between the panels in the folded position.

13. The set of stowable rigid sails of claim 1, wherein the plurality of sails are arranged in opposed pairs.

14. The set of stowable rigid sails of claim 1, wherein the plurality of sails are mounted on a boat hull.

15. The set of stowable rigid sails of claim 14, further comprising a turbine for generating a brake effect to transform the wind power into rotation power at the axis of said turbine.

16. The set of stowable rigid sails of claim 15, further comprising a means for generating electric power by an alternator/dynamo associated with the turbine or pressurised air by a compressor associated with the turbine to store air in high pressure tanks housed inside the hull.

17. The set of stowable rigid sails of claim 15, wherein said masts are telescopically extendable.

* * * * *